US009721437B2

(12) United States Patent
Pececnik

(10) Patent No.: US 9,721,437 B2
(45) Date of Patent: Aug. 1, 2017

(54) SLOT MACHINE WITH SECONDARY GAME CONTENT

(71) Applicant: Joze Pececnik, Smarca (SI)

(72) Inventor: Joze Pececnik, Smarca (SI)

(73) Assignee: INTERBLOCK D.D., Menges (SI)

( * ) Notice: Subject to any disclaimer, the term of this patent is extended or adjusted under 35 U.S.C. 154(b) by 510 days.

(21) Appl. No.: 14/536,630

(22) Filed: Nov. 9, 2014

(65) Prior Publication Data

US 2016/0133100 A1 May 12, 2016

(51) Int. Cl.
*G07F 17/34* (2006.01)
*G07F 17/32* (2006.01)

(52) U.S. Cl.
CPC ..... *G07F 17/34* (2013.01); *G07F 17/3211* (2013.01); *G07F 17/3244* (2013.01)

(58) Field of Classification Search
CPC ..... G07F 17/34
USPC ..... 463/7, 17, 20.25, 42; 273/349
See application file for complete search history.

(56) References Cited

U.S. PATENT DOCUMENTS 5,573,243 A * 11/1996 Bartosik ..... A63F 9/14 273/349
5,954,338 A * 9/1999 Hampton ..... A63F 9/14 273/349
6,080,061 A * 6/2000 Watanabe ..... G07F 17/3202 273/144 R
6,780,103 B2 8/2004 Bansemer et al.
7,507,154 B1 * 3/2009 D'Avanzo ..... G07F 17/3213 463/16
7,959,506 B2 * 6/2011 Toyoda ..... G07F 17/32 273/457
8,075,391 B2 12/2011 Rommerdahl et al.
8,096,892 B2 1/2012 Henry et al.
8,251,799 B2 8/2012 Rommerdahl et al.
8,348,747 B2 1/2013 Arezina et al.
8,430,737 B2 4/2013 Saunders
8,475,263 B2 7/2013 Rommerdahl et al.
8,690,660 B2 4/2014 Saunders et al.
8,764,538 B2 7/2014 Lutnick et al.
8,764,541 B2 7/2014 Lutnick et al.
8,784,186 B2 7/2014 Rommerdahl et al.
8,790,175 B2 * 7/2014 Aoki ..... G07F 17/3244 463/25
2006/0003836 A1 * 1/2006 Seelig ..... G07F 17/3211 463/25
2007/0026924 A1 2/2007 Taylor

* cited by examiner

*Primary Examiner* — Dmitry Suhol
*Assistant Examiner* — Ankit Doshi
(74) *Attorney, Agent, or Firm* — Mark A. Litman & Associates, P.A.

(57) ABSTRACT

A gaming apparatus has both a base wagering game apparatus with a processor, symbol display component and player input controls, and a secondary game element visible from the base wagering game. The secondary game element has a see-through container that is liquid proof, a fluid source and a pump to move fluid into and out of the see-through container. Winning outcomes in the base wagering game cause the pump in the secondary game element to change a visible volume of liquid within the container so that a changed level of liquid within the container can be seen. When a predetermined level of liquid is attained within the container, a bonus payment or bonus game is initiated as a resolution of wagers placed through the player input controls.

18 Claims, 5 Drawing Sheets

SLOT MACHINE WITH SECONDARY GAME CONTENT

BACKGROUND OF THE INVENTION

1. Field of the Invention

The present invention relates to gaming apparatus, single and group play gaming apparatus, slot gaming apparatus, or video gaming apparatus and such gaming apparatus associated with associated apparatus that supports additional game content, including bonus events and bonus payouts to one or more players.

2. Background of the Art

Gaming devices typically include an array of mechanical elements on which wagers can be placed. The most common gaming device is the slot machine. This is a device that allows wagers to be entered in a mechanical or electromechanical machine, and the machine generates a random or pseudo-random outcome producing, for example, sets of symbols. These sets of symbols are usually displayed in columns and rows. Predetermined sets or collections or sequences of the symbols within the columns or rows are defined as winning outcomes, and other sets are therefore losing outcomes. Originally slot machines were mechanical devices employing 3 physical reels with various symbols displayed on the reels. After placing a wager, the reels were put into motion and randomly stopped. Wagers were paid depending upon the outcome of the types and positions of symbols.

Gaming machines, such as the standard slot machines have evolved, particularly with the advent of computer technology, which has enabled far greater variety in game play and additional features. Most present day machines are processor driven and have video display monitors. The processor based systems allow for not only a better visual appearance, but significant variation in the underlying games, the ordering of play lines, side bet games, bonus games, and complex wagers and games that are automatically processed. Rather than the earliest three-reel slot machines with a single pay line, a single machine may play one hundred (100) or more games at a single time, and even have multiple games with 10, 20 30 or more separate pay lines.

Typical random frame symbol video slots have, for example, three rows and five columns of available frames within which symbols are randomly provided. The pay lines may be horizontal, vertical, diagonal or non-liner (e.g., zig-zag) and random symbols of special types may be used for what is known as a scatter pay, where the appearance of a certain number of symbols anywhere on the screen is determined to be a winning event.

Second screen, top box, bonus and other special features have become desirable to add variety and the potential for larger awards to the game. The addition of progressive jackpots, in which a portion of a wager from one or more machines builds up in a pot or jackpot, and that jackpot is awarded on an infrequent event, have also become popular. The use of the computer, processor, interconnectivity and video displays have greatly advanced the use of such systems.

Lower denomination games (e.g., $0.01 unit wagers, $0.05 unit wagers) have become very popular. By providing large numbers of pay lines and large numbers (e.g., up to 100.times. units per pay line), significant revenue can still be generated from small denomination unit wagers.

Although the term reel mapping refers to the distribution and proportions and frequency of images on physical reels, electronic systems perform a similar function to provide random outcomes from the virtual or video reels. This can be done by random number generators, which can be weighted to vary the probabilistic frequency of individual symbols. For example, if there are twelve different symbols that can theoretically be possible on a single column (a single virtual reel), the random number generator may have 1000 available numbers that are randomly selected. Symbol 1 may have 250 out of the 1000 numbers, and therefore have a probability of occurrence of 250/1000. That symbol would likely be a low value or likely losing symbol or a blank space. Symbol 2 might have 150 numbers assigned to that symbol, so that it would appear 150/1000 spins. That symbol would also likely have a low potential value in gaming outcomes, such as a lemon in traditional slot symbol events. Symbol 3 also might have 150 numbers assigned to that symbol, so that it would appear 150/1000 spins. That symbol would also likely have a low potential value in gaming outcomes, such as a plum in traditional slot symbol events. This distribution has already used up more than half of the available numbers from the random number generator (550/1000). More valuable or potentially valuable symbols will have fewer numbers assigned to them, so that the random number generator will select those more valuable symbols less frequently on a long term event basis. Each reel may be separately weighted. For example, a maximum jackpot symbol that requires five matching symbols in a horizontal row may be weighted so that there are 4/1000 numbers assigned in the first column, 3/1000 numbers in the second column 8/1000 numbers in the third column, 20/1000 in the fourth column, and 1/1000 in the fifth column. If the same numbers were assigned to each symbol in each column, there would be less control over the frequency of the final output.

The term "reel" as traditionally referencing a physical reel in a slot machine, is still a convenient term to reference event outcomes, whether the reel event outcomes being referred to are individual frame outcomes (e.g., a single symbol), individual column outcomes (e.g., the locus of frames that would normally appear on a single physical reel) o, column outcomes (where adjacent reel symbols are sequential and horizontal or game outcomes where all available symbol-holding positions have symbols or blank spaces assigned to them.

Bonus events may take many different forms. The bonus events may be triggered or randomly occur. Bonuses may be separate games, increased awards on games similar to the underlying game being played, selection games (e.g., pick and reveal), or random event outcomes run by the processor.

Published U.S. Patent Application Document No. 20070026924 (which claims priority from U.S. Provisional Application Ser. No. 60/702,305 filed on Jul. 23, 2005) describes a gaming device comprising: at least one symbol display that includes at least one award symbols, said award symbol associated with at least one award; a plurality of prize indicators, wherein each has an associated number of awards needed to access said prize indicator, and each of said prize indicators includes at least one prize; a processor operable with said symbol display to generate the award symbols and to enable the player to selectively access at least one prize. Many different variations and alternatives are described therein relating to bonus games.

U.S. Pat. Nos. 8,784,186; 8,251,799; 8,075,391; and 8,475,263 (Rommerdahl) discloses a game and method for a game including a perceived skill component comprising a skill-based award and a supplemental award that, when summed, are equal in value to a predetermined award. An image of popping balloons is shown as game results.

U.S. Pat. No. 6,780,103 (Bansemer) provides a gaming device, wherein a player's skill at an action or event determines the player's success or failure in the round. The game is readily adaptable to becoming a pseudo-skill game that would be required in most gaming jurisdictions. In one pseudo-skill embodiment, the skill game is converted to a game employing skill, but which is controlled by a set number of successful outcomes. That is, the player keeps playing until the player's skill produces the set number of successful outcomes. In another pseudo-skill embodiment, the game only appears to the player as involving skill. Instead, the gaming device randomly determines when and how many times to produce a successful outcome and increase the player's award. Bottles are virtually broken as indication of psuedo-skill outcomes.

U.S. Pat. Nos. 8,764,541 and 8,764,538 enable a secondary player to make a bet that pays based on aggregate data from multiple games of primary players. Bottles of wine may be delivered to players at gaming machines as an award.

U.S. Pat. Nos. 8,690,660 and 8,430,737 (Saunders) enables a gaming system including a cascading symbol game which utilizes a plurality of adjacent symbol display position grids arranged at different depths. The multiple symbol display position grids at different depths provides that one or more of the symbols of at least a first symbol display position grid at a first depth are displayed to a player while one or more of the symbols of at least a second symbol display position grid at a second depth are not displayed to the player. When one or more symbols are removed from the first symbol display position grid at the first depth, before and/or after shifting the remaining displayed symbols from the first symbol display position grid into created empty symbol display positions of the first symbol display position grid, one or more symbols from the second symbol display position grid at the second depth become exposed. The game includes a non-functional balloon symbol which inflates more each time the designated symbol is included in a winning symbol combination.

U.S. Pat. No. 8,348,747 (Arezina) describes a multiplayer gaming system sensing multiple simultaneous contacts on a surface of a gaming table, differentiating contacts by different players. Privacy controls selectively display private information visible to only one of the players on or near the display surface of the gaming table. The gaming system also detects physical objects placed on the surface of the gaming table, causing wagering game functions or peripheral functions to be performed as a result of the placement of the object on the display surface. A virtual spinning bottle is used as a pointing device.

U.S. Pat. No. 8,096,892 (Henry) describes a control system for a water amusement system. The control system is configured to operate the water amusement system to produce water effects, sound effects, and/or light effects when the control system receives an activation signal. The activation signal may be sent to the control system by an activation point, such as an optical touch button, or a water target. The control system is further configured to produce water effects, sound effects, and/or light effects in the absence of an activation signal to attract participants to the water amusement system.

Additional game technology with functional mechanical elements and additional game play and/or bonus features are desirable to maintain interest in electromechanical gaming apparatus.

SUMMARY OF THE INVENTION

A gaming apparatus has:

a) a base wagering game apparatus comprising a processor, symbol display component and player input controls; and b) a secondary game element visible from the base wagering game, wherein the secondary game element comprises a see-through container that is liquid proof, a fluid source and a pump to move fluid into and out of the see-through container;

wherein winning outcomes in the base wagering game causes the pump in the secondary game element to change a visible volume of liquid within the container so that a changed level of liquid within the container can be seen, and when a predetermined level of liquid is attained within the container, a bonus payment or bonus game is initiated as a resolution of wagers placed through the player input controls.

DETAILED DESCRIPTION OF THE INVENTION

Figure 1:
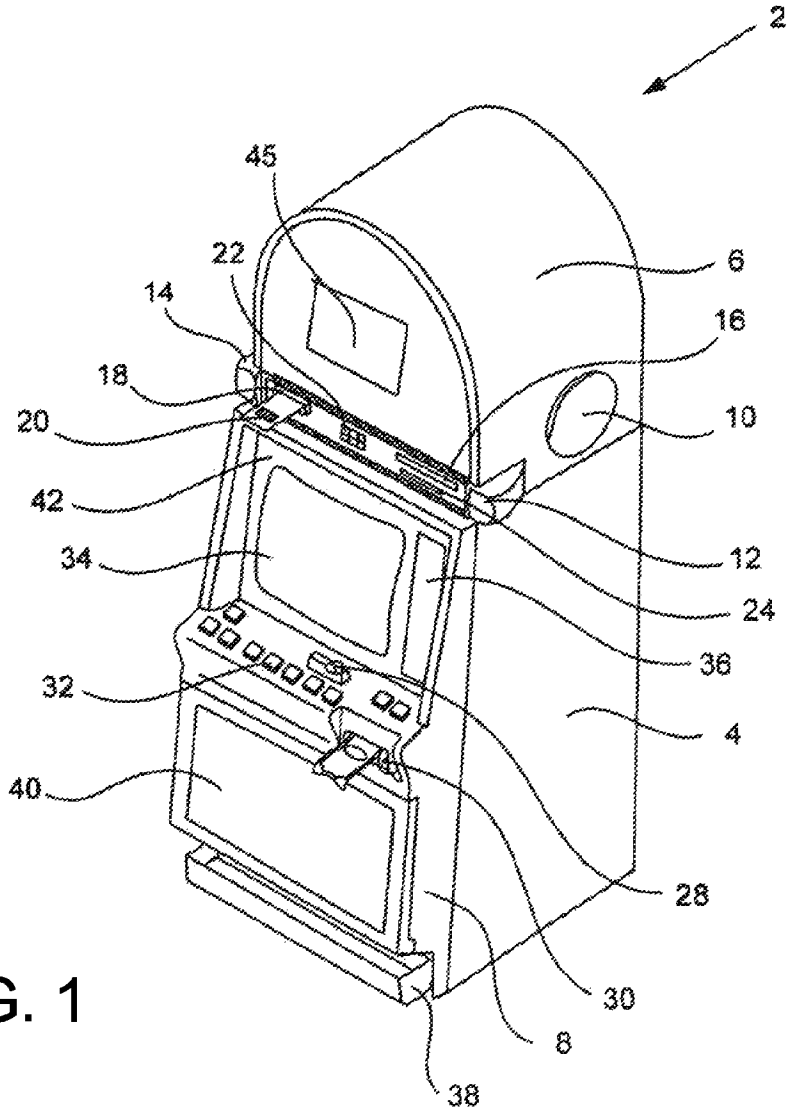
FIG. 1 shows an electronic gaming table on which the gaming method may be executed.

A gaming apparatus has:

a) a base wagering game apparatus comprising a processor, symbol display component and player input controls; and b) a secondary game element visible from the base wagering game, wherein the secondary game element comprises a see-through container that is liquid proof, a fluid source and a pump to move fluid into and out of the see-through container;

wherein winning outcomes in the base wagering game causes the pump in the secondary game element to change a visible volume of liquid within the container so that a changed level of liquid within the container can be seen, and when a predetermined level of liquid is attained within the container, a bonus payment or bonus game is initiated as a resolution of wagers placed through the player input controls.

The gaming apparatus container may be enclosed within a transparent (transparent or translucent) enclosure (a box, cylinder or framed volume) so that an exterior surface of the container is separated by an open volume from an inner surface of the transparent enclosure. The container may be any transparent (e.g., including translucent) material. A preferred embodiment is where the container is rigid (e.g., it does not changes its external volume significantly (less than ±2%) when liquid fills the container or when all liquid has been drained from the container.

Various alternatives in the physical structure of the base game system and the secondary game element may be used in the practice of the present technology. The base wagering game element may be selected from among all of the standard gaming elements, such as 3×3 reel slots, 3×5 reel slots, 3×3 (rows and columns) video virtual reels, 3×5 (columns and rows), 5×5 (columns and rows), radial distributions of symbols, linear paylines, non-linear paylines, scatter pay symbol displays, and the like.

In the operation of the secondary game element, the open volume may remain filled with a gas as the level of liquid changes within the container, or liquid may be present (up to a limit) within the volume around the container. The liquid could flow over the container within the disclosure, but that is visually less attractive and makes fluid retention within the device less secure. The predetermined level of liquid may be attained by adding liquid into the container to raise the visible level of liquid or attained by removing water from the container to lower the visible level of liquid. The liquid may be clear, translucent, colored, dye-filled, particulate filled as a suspension or emulsion, may be lit from below or above, and may even be sufficiently optically dense as to be relatively opaque (e.g., an optical density through 5.0 centimeters thickness of at least 5.0). The gaming apparatus may be constructed where there are multiple base wagering game apparatuses associated with a single secondary game element. The gaming apparatus may also be configured such that each of the multiple base wagering game apparatus contributes to altering the level of liquid within the container. The liquid should be aqueous or other liquid that does not attack the composition of the container, the pipes or the reservoir. Water, water with polyethylene glycol, alcohols, especially C6 alcohols and higher, fluid polymers, oils, and the like may be used.

The gaming apparatus may be configured such that only one of the multiple base wagering game apparatus receives a bonus payment or bonus game when the predetermined level of liquid is attained within the container, or such that more than one of the multiple base wagering game apparatuses receive a bonus payment or bonus game when the predetermined level of liquid is attained within the container. The processor may also be configured so that a predetermined outcome must occur in one of the multiple base wagering games after a predetermined level of liquid to trigger the bonus payment or bonus game. The gaming apparatus processor may also be configured to alter the predetermined outcome that must occur according to changes in the level of liquid. The gaming apparatus processor may also be configured to alter the predetermined outcome that must occur according to a degree of changes in the level of liquid.

The gaming system may have the container be rigid and does not expand or deflate as the volume of liquid changes in the container or the container is inflatable and expands or deflates as the volume of liquid changes in the container.

An alternative description of the gaming apparatus can be:

a) a base wagering game apparatus comprising a processor, symbol display component and player input controls; and b) a secondary game element visible from the base wagering game, wherein the secondary game element comprises a virtual see-through container, a virtual fluid source and the processor is configured to move virtual fluid into and out of the virtual container;

wherein winning outcomes in the base wagering game causes the secondary game element to change a visible virtual volume of liquid within the virtual container so that a changed level of virtual liquid within the virtual container can be seen, and when a predetermined level of virtual liquid is attained within the virtual container, a bonus payment or bonus game is initiated as a resolution of wagers placed through the player input controls.

Viewing the figures will enhance an appreciation of the nature and operation of the present technology.

Figure 2:
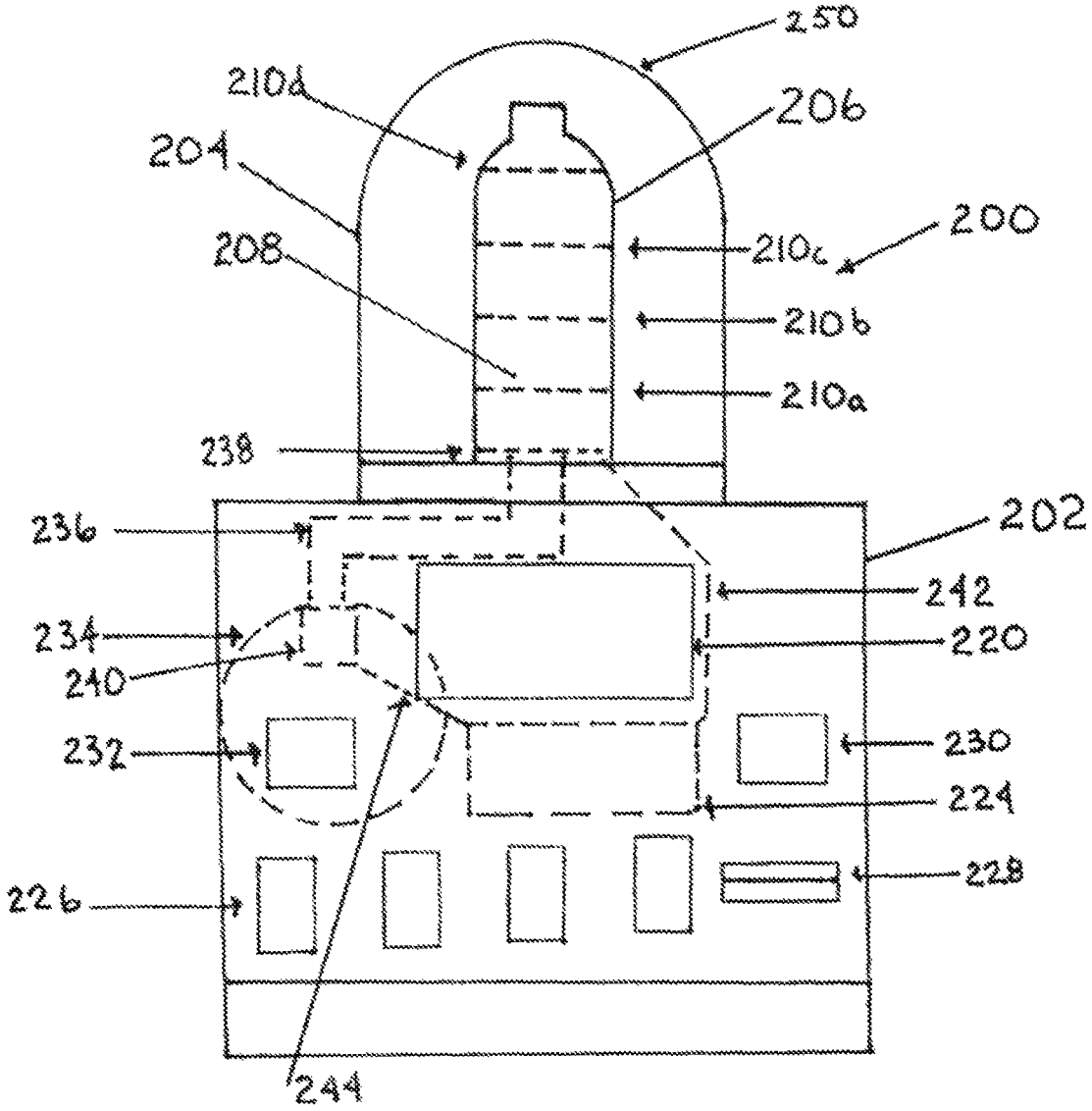
FIG. 2 shows a front view of a gaming device according to an embodiment of the present technology.

FIG. 2 shows a front view of a gaming device 200 according to an embodiment of the present technology. The base gaming segment 202 can comprise the standard underlying electromechanical gaming device as known in the art (both physical reel slots and video gaming technology) that is modified to operate with the additional mechanical and software components of the present technology. The system 200 comprises the base gaming component 202 and the secondary associated gaming element 250. The base gaming element 202 has standard components of player input controls 226, a display area 220 for display of symbols determining outcomes of games (symbols, numbers, letters, images, playing cards, etc.), a credit display 232, a credit, currency or ticket-in-ticket-out receiver 228, a paytable display 230 and a processor/gaming engine 224. Within the base gaming segment 202 is novel gaming structure and elements such as the liquid reserve tank 234, a liquid pump 240 in communication 244 with the processor 224, and a tube or pipe 236 to carry fluid.

The secondary gaming element 250, which has functional engagement within the gaming apparatus is demonstrated as having a transparent enclosing structure 204 (here shown as a dome), an enclosed fluid container 206 (here shown as a bottle or flask), an internal volume 208 in the container 206, a fluid pressure sensing plate 238 having a communication link 242 to the processor 220, and markings 210*a*, 210*b*, 210*c* and 210*d* showing markings for different levels of fluid within the container 206.

In operation, using video poker gaming as an example, as ranked winning hands are displayed on the symbol display screen 220, the processor not only indicates player credit status based upon winning outcomes in the credit display 232, but also triggers the fluid pump 240 to add or subtract fluid between the reservoir 234 and the container 206 through the pipes 236. The amount of water present in the container can be observed by players through the transparent enclosure 204 and its level may be identified with respect to the markings 210*a*, 210*b*, 210*c* and 210*d*. These markings 210*a*, 210*b*, 210*c* and 210*d* (as later described in game execution steps) may or may not be structurally significant. As high ranked hands are achieved (or valuable symbol combinations) in the play of the underlying game, fluid is pumped into or out of the container 206 to alter the level of fluid within the container 206. If the container 206 begins the game sequence with no fluid or only a little fluid in the container, fluid may be added by winning events, either uniformly according to any winning event (at least a push or at least a return better than the original wager, for example), or only winning events of a specific relatively high rank (e.g., again using poker as an example, at least 3-of-a-kind, at least a straight, etc.) must be required to cause liquid to be added or subtracted from the container, and the rate of addition (volume of liquid) may change depending upon the rank of the hand (e.g., 3-of-a-kind adds 1% of the volume of the container, a straight adds 2% of the volume of the container, a flush adds 2.5% of the volume of the container, a full-house adds 4% of the volume of the container, four-of-a-kind adds 8%, a straight flush adds 25%, and a royal flush completely fills the container).

Figure 3:
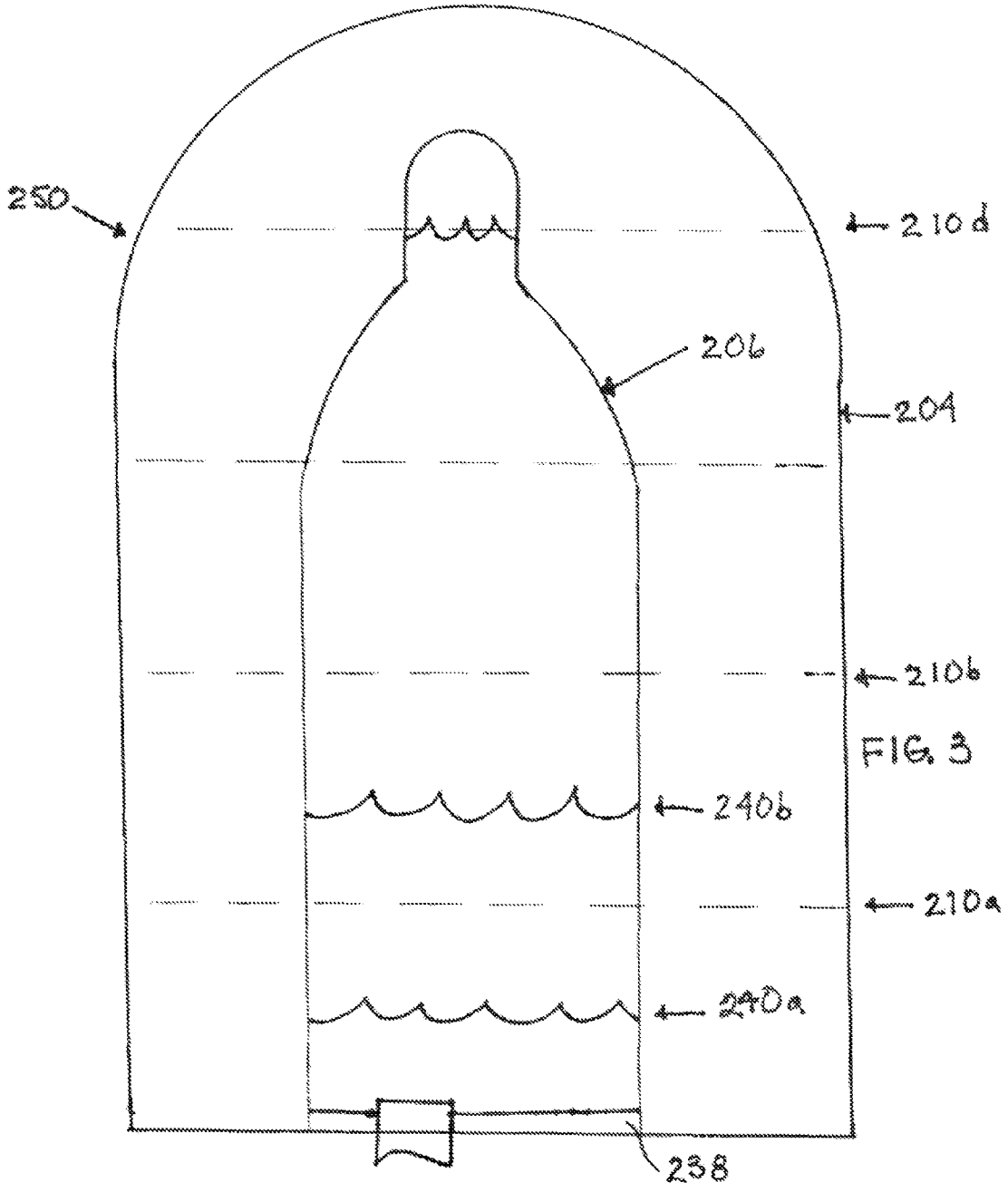
FIG. 3 shows a front view of a secondary game element according to an embodiment of the present invention.

FIG. 3 shows a front view of a secondary game element 250 according to an embodiment of the present invention. Like numbers in this Figure and FIG. 2 identify like objects. The marker lines 210*a*, 210*b* and 210*d* are shown on the enclosing dome 204 instead of the container 206. The marker 210*a* indicates a first tier of liquid level at which game content may change. For example, to stimulate play on the gaming apparatus 200, a maximum outcome might be achieved at a lower rank than when the liquid level is higher, but at the same time, the winning amount might be lower or higher. For example, when the liquid level is below marker 210*a*, to win a maximum allowed portion of a progressive (or fixed value) jackpot, only a full-house may be necessary, but the maximum portion would be only 25% of the total progressive (or fixed value) jackpot. When the liquid level rises above marker 210*a* and below 210*b*, the maximum portion that can be won could be 40% of the total progressive (or fixed value) jackpot for a 4-of-a-kind. Similarly, when the water level goes above 210*b* and below the next marker, the maximum allowable jackpot payout could be 70% with at least a straight-flush required. When the liquid level reaches the maximum level at marker 210*d*, 1005 of the jackpot may be available, but only with a royal flush. This format might also be reversed, with higher portions of the jackpot available with a royal flush at lower marker levels, and with only smaller portions of the jackpot available, but at a lower poker initial poker rank. This variation in rank (or symbol complexity or rarity) and amount of available jackpot can be used to attract players at different stages of the liquid fill. One problem that casinos have faced with electronic gaming apparatus with progressive jackpots or varying jackpots is that players 'shop' machines to see where unique benefits are higher than at other machines, avoiding play at machines or banks of machines where payouts are more difficult or payouts are lower. By offering the ability to control the degree of difficulty of winning outcomes and the amount (percentage) that can be won from a jackpot by varying the parameters dependent upon the level of liquid within the container offers a solution that can control player desirability of entering game play at the machine or bank of machines.

A method of playing a wagering game on the apparatus described herein may include steps wherein the processor accepts a wager on a wagering game played on the base wagering game apparatus. As described above, when the processor recognizes a winning outcome (or a winning outcome of a certain predetermined quality, low frequency or rank) on at conclusion of a round of play of the wagering game, the processor causes an exchange of liquid between the reservoir and the container so that a liquid level in the container is altered (container volume of liquid is filled or lowered), and predetermined amounts of altered volumes of liquid in the container alter amounts of at least one payout available during play of a next round of the wagering game.

Turning next to FIG. 1, a video gaming machine 2 that may be used as the underlying base gaming counsel of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display— mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modem general-purpose computers include voltage monitoring circuitry, these types of circuits only report voltage status to the operating software. Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, the Netplex™ system of JOT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot, machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 1A:
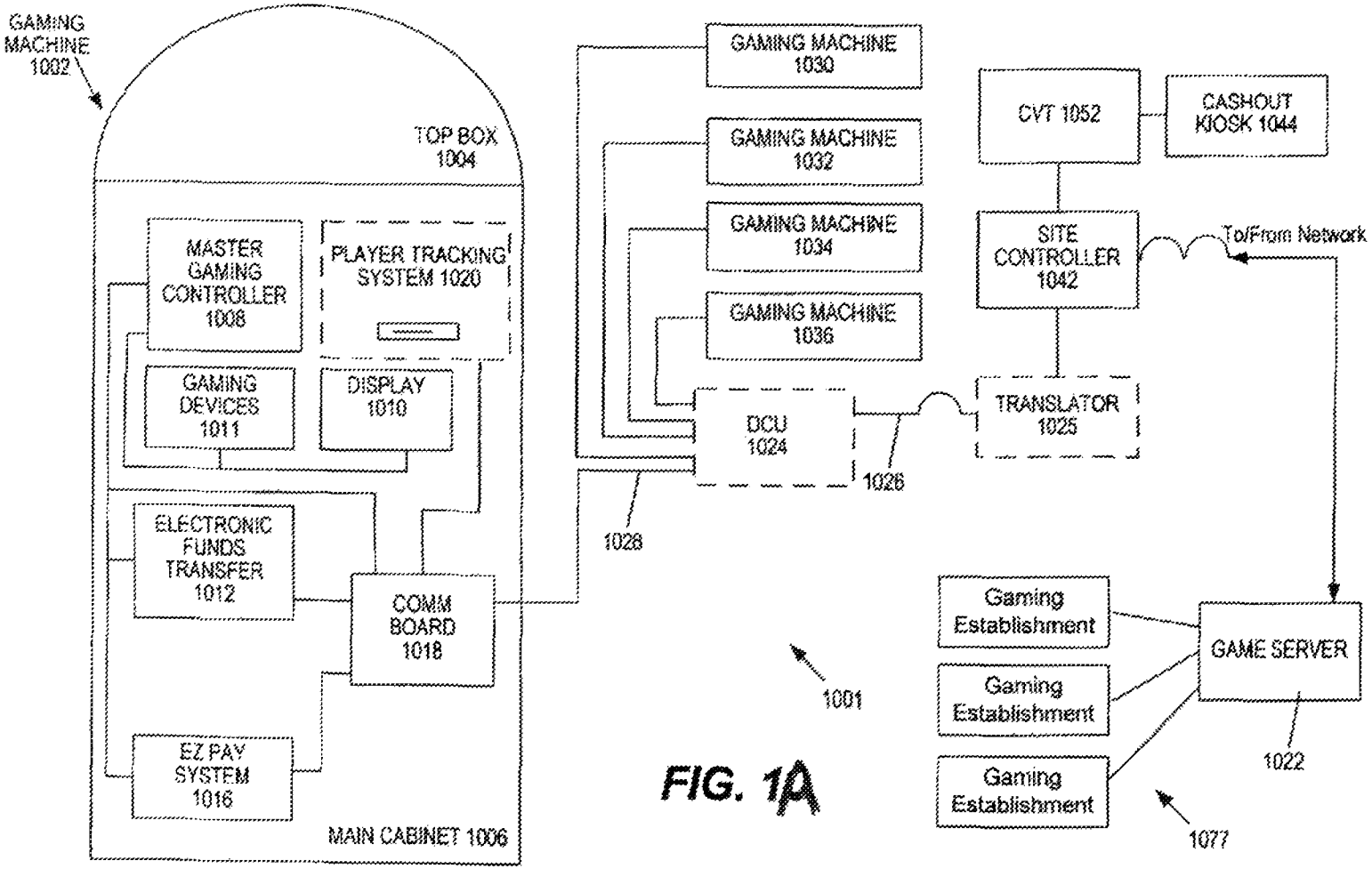
FIG. 1A shows a schematic for an electronic system for enabling play of the gaming method described herein.

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022. Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking. Therefore, master gaming controller 1008 may also communicate with EFT system 1012, EZPay™ system, and player tracking system 1020.

The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 1B:
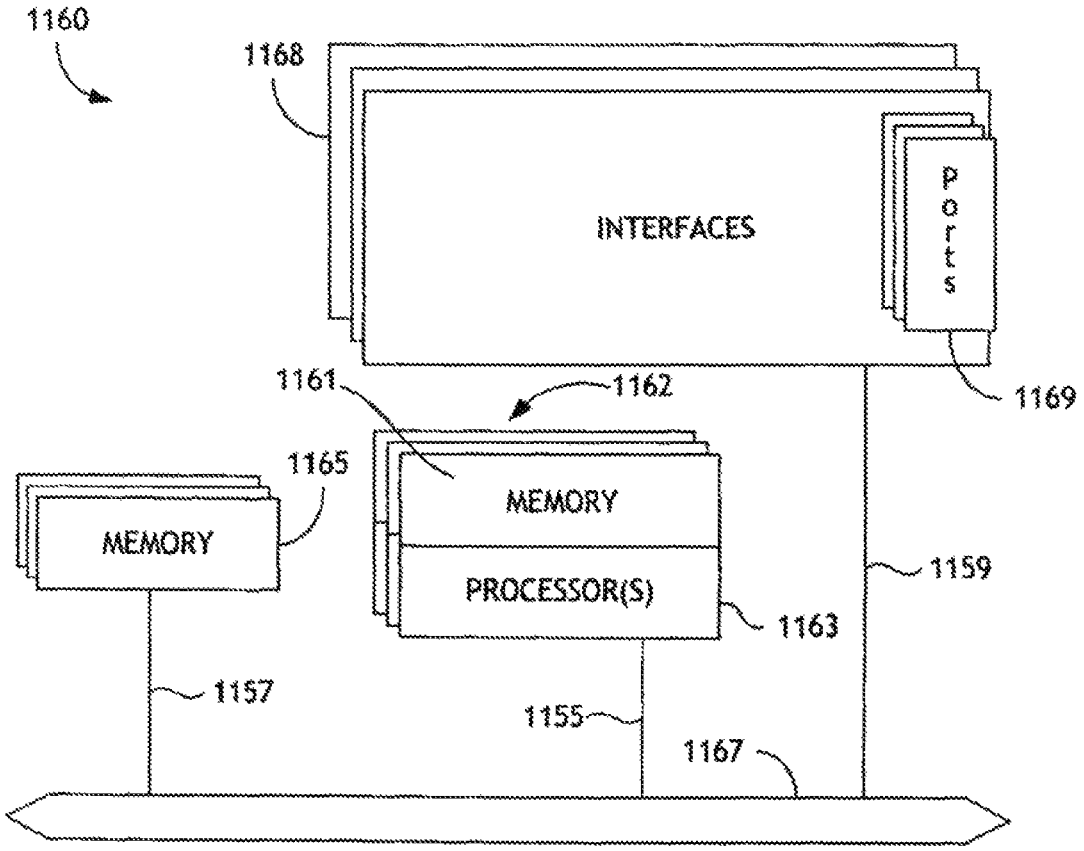
FIG. 1B shows another schematic for an electronic system for enabling play of the gaming method described herein.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

The CPU system may perform additional functions unique to the operation of the present gaming system. The CPU may be engaged with flow meters to measure rates or flow of liquid, volume of total water in the system (by measuring volume in the reservoir when a lowest amount of fluid is in the container and pipes, determination of proportionate payouts dependent upon fluid levels and execution of unique game code. A densitometer in the fluid flow path may be present to determine deterioration in color density or discoloration of the fluid due to contamination, and an alarm is sounded when the color quality (density, tone, wavelengths of absorption and the like) varies beyond predetermined parameters.

These and other aspects of the technology may be varied within the generic scope of the invention with alternatives and substitutions.

What is claimed:

1. A gaming apparatus comprising:

a) a base wagering game apparatus comprising a processor, symbol display component and player input controls, said base wagering game apparatus enabling a base wagering game; and b) a secondary game element visible from the base wagering game, wherein the secondary game element comprises a see-through container that is liquid proof, a fluid source and a pump to move fluid into and out of the see-through container;

wherein winning outcomes in the base wagering game causes the pump in the secondary game element to change a visible volume of liquid within the container so that a changed level of liquid within the container can be seen, and when a predetermined level of liquid is attained within the container, a bonus payment or bonus game is initiated as a resolution of wagers placed through the player input controls.

2. The gaming apparatus of claim 1 wherein the container is enclosed within a transparent enclosure so that an exterior surface of the container is separated by an open volume from an inner surface of the transparent enclosure.

3. The gaming apparatus of claim 2 wherein the open volume remains filled with a gas as the level of liquid changes within the container.

4. The gaming apparatus of claim 1 wherein the predetermined level of liquid is attained by adding liquid into the container to raise the visible level of liquid.

5. The gaming apparatus of claim 1 wherein the predetermined level of liquid is attained by removing water from the container to lower the visible level of liquid.

6. The gaming apparatus of claim 1 wherein there are multiple base wagering game apparatuses associated with a single secondary game element.

7. The gaming apparatus of claim 6 wherein each of the multiple base wagering game apparatus contributes to altering the level of liquid within the container.

8. The gaming apparatus of claim 7 wherein only one of the multiple base wagering game apparatus receives a bonus payment or bonus game when the predetermined level of liquid is attained within the container.

9. The gaming apparatus of claim 7 wherein more than one of the multiple base wagering game apparatuses receive a bonus payment or bonus game when the predetermined level of liquid is attained within the container.

10. The gaming apparatus of claim 8 wherein the processor is configured so that a predetermined outcome must occur in one of the multiple base wagering games after a predetermined level of liquid to trigger the bonus payment or bonus game.

11. The gaming apparatus of claim 9 wherein the processor is configured so that a predetermined outcome must occur in one of the multiple base wagering games after a predetermined level of liquid to trigger the bonus payment or bonus game.

12. The gaming apparatus of claim 10 wherein the processor is configured to alter the predetermined outcome that must occur according to changes in the level of liquid.

13. The gaming apparatus of claim 11 wherein the processor is configured to alter the predetermined outcome that must occur according to a degree of changes in the level of liquid.

14. The gaming apparatus of claim 12 wherein the processor is configured to alter the predetermined outcome that must occur according to a degree of changes in the level of liquid.

15. The gaming system of claim 1 wherein the container is rigid and does not expand or deflate as the volume of liquid changes in the container.

16. The gaming system of claim 11 wherein the container is rigid and does not expand or deflate as the volume of liquid changes in the container.

17. The gaming system of claim 11 wherein the container is inflatable and expands or deflates as the volume of liquid changes in the container.

18. A method of playing a wagering game on a gaming apparatus comprising, a) a base wagering game apparatus comprising a processor, symbol display component and player input controls, said base wagering game apparatus enabling a base wagering game;

b) a secondary game element visible from the base wagering game, wherein the secondary game element comprises a see-through container that is liquid proof, a fluid source and a pump to move fluid into and out of the see-through container;

wherein winning outcomes in the base wagering game causes the pump in the secondary game element to change a visible volume of liquid within the container so that a changed level of liquid within the container can be seen, and when a predetermined level of liquid is attained within the container, a bonus payment or bonus game is initiated as a resolution of wagers placed through the player input controls; and wherein the processor accepts a wager on a wagering game played on the base wagering game apparatus, and when the processor recognizes a winning outcome on at conclusion of a round of the wagering game, the processor causes an exchange of liquid between a reservoir and the container so that a liquid level in the container is altered, and predetermined amounts of altered volumes of liquid in the container alter amounts of at least one payout available during play of a next round of the wagering game.

* * * * *